US009205570B2

(12) United States Patent
Perez et al.

(10) Patent No.: US 9,205,570 B2
(45) Date of Patent: Dec. 8, 2015

(54) HOLLOW FORM TURNING DEVICE

(75) Inventors: Leland T. Perez, Alto, MI (US); Jeffrey S. Folkert, Hudsonville, MI (US); Michael B. Baird, Hudsonville, MI (US)

(73) Assignee: CARTER PRODUCTS COMPANY, INC., Grand Rapid, MI (US)

( * ) Notice: Subject to any disclaimer, the term of this patent is extended or adjusted under 35 U.S.C. 154(b) by 721 days.

(21) Appl. No.: 13/474,139

(22) Filed: May 17, 2012

(65) Prior Publication Data

US 2012/0291600 A1 Nov. 22, 2012

Related U.S. Application Data

(60) Provisional application No. 61/487,972, filed on May 19, 2011.

(51) Int. Cl.
*B27G 15/00* (2006.01)
*B27C 7/06* (2006.01)

(52) U.S. Cl.
CPC . *B27G 15/00* (2013.01); *B27C 7/06* (2013.01); *Y10T 82/10* (2015.01); *Y10T 82/2583* (2015.01); *Y10T 82/2585* (2015.01)

(58) Field of Classification Search
CPC ..... B27C 7/06; B23B 1/00
USPC ..... 142/48, 49, 56, 55; 82/158, 112, 113, 82/12
See application file for complete search history.

(56) References Cited

U.S. PATENT DOCUMENTS 476,696 A * 6/1892 Stoner et al. ..... 142/42
652,358 A * 6/1900 Grode ..... 142/38
839,752 A * 12/1906 Guenzler ..... 142/49
952,474 A * 3/1910 Hushinson ..... 142/1
1,036,257 A * 8/1912 Kacsmaril ..... 82/137
1,487,538 A * 3/1924 Chadek ..... 142/38

(Continued)

FOREIGN PATENT DOCUMENTS

FR 2658749 A1 * 8/1991 ..... B27C 7/00
GB 2083396 A * 3/1982 ..... B23B 29/18

(Continued)

OTHER PUBLICATIONS

Behemoth Hollowing System, http://behemothtools.tripold.com (Apr. 29, 2011).

(Continued)

*Primary Examiner* — Sunil K Singh
*Assistant Examiner* — Sara Addisu
(74) *Attorney, Agent, or Firm* — Price Heneveld LLP

(57) ABSTRACT

A hollow turning device comprises a tool handle, a cutting bar extending from one end of the tool handle having a longitudinal axis and a cross section at least a portion of which is non-circular, and a cutting tool disposed at a distal end of the cutting bar. A tool rest is disposed adjacent the work piece. A torque arrestor has a pair of spaced apart cooperating rollers between which the cutting bar extends, the cooperating rollers being spaced apart to fittingly receive and restrain the cutting bar to allow motion of the cutting bar between the cooperating rollers to facilitate motion of the cutting tool within the hollow to shape the inside of the work piece, wherein the non-circular portion of the cutting bar cross section prevents vertical movement and rotation of the cutting bar along its longitudinal axis when the cutting tool engages the work piece.

19 Claims, 6 Drawing Sheets

(56) References Cited

U.S. PATENT DOCUMENTS

| | | | | | |
|---|---|---|---|---|---|
| 1,779,085 | A | * | 10/1930 | Blasi | 142/48 |
| 2,068,625 | A | * | 1/1937 | Burton | 142/38 |
| 2,712,920 | A | * | 7/1955 | Cullen et al. | 175/99 |
| 2,919,727 | A | * | 1/1960 | Brewer, Jr. | 142/55 |
| 3,277,933 | A | * | 10/1966 | Lalli | 142/47 |
| 3,304,969 | A | * | 2/1967 | MacDougall | 144/35.1 |
| 3,405,745 | A | * | 10/1968 | Schoonover et al. | 142/1 |
| 3,721,279 | A | * | 3/1973 | Bowen | 142/1 |
| 3,768,527 | A | * | 10/1973 | Messick | 142/38 |
| 3,812,746 | A | * | 5/1974 | Saari | 82/18 |
| 4,063,577 | A | * | 12/1977 | Tennant | 142/49 |
| D273,386 | S | * | 4/1984 | Adler | D15/138 |
| 4,502,517 | A | * | 3/1985 | Larson | 142/49 |
| 4,527,602 | A | * | 7/1985 | Martin | 142/55 |
| 4,580,470 | A | * | 4/1986 | Buck | 82/127 |
| 4,615,365 | A | * | 10/1986 | Arnall | 142/49 |
| 4,924,924 | A | * | 5/1990 | Stewart | 142/49 |
| 4,998,572 | A | * | 3/1991 | Lukes | 142/55 |
| 5,224,529 | A | * | 7/1993 | Kenny | 142/42 |
| 5,441,089 | A | * | 8/1995 | Lazarou | 142/49 |
| 5,572,915 | A | * | 11/1996 | Bertini | 82/127 |
| 5,597,023 | A | * | 1/1997 | Heintzeman | 144/204.2 |
| 5,839,333 | A | * | 11/1998 | McKay | 82/1.11 |
| 6,012,364 | A | * | 1/2000 | Peterson et al. | 82/157 |
| 6,253,812 | B1 | * | 7/2001 | Rinehart | 142/56 |
| D481,604 | S | * | 11/2003 | Woodruff | D8/71 |
| 7,191,689 | B2 | | 3/2007 | Clark | |
| 2002/0092388 | A1 | * | 7/2002 | Miller | 82/115 |
| 2004/0244547 | A1 | * | 12/2004 | Clark | 82/158 |
| 2007/0261522 | A1 | * | 11/2007 | Bono et al. | 82/158 |
| 2008/0202297 | A1 | * | 8/2008 | Hirose | 82/159 |
| 2010/0139808 | A1 | * | 6/2010 | Thompson et al. | 142/49 |
| 2010/0275748 | A1 | * | 11/2010 | Wang | 82/158 |
| 2013/0074988 | A1 | * | 3/2013 | Chou | 142/49 |
| 2014/0123822 | A1 | * | 5/2014 | Dougherty | 82/158 |

FOREIGN PATENT DOCUMENTS

| | | | | | |
|---|---|---|---|---|---|
| GB | 2253587 | A | * | 9/1992 | B27C 7/00 |
| GB | 2311241 | A | * | 9/1997 | B23Q 35/10 |
| GB | 2397039 | A | * | 7/2004 | B23B 3/06 |
| JP | 06182601 | A | * | 7/1994 | B23B 5/12 |

OTHER PUBLICATIONS

Clark Deep Hollowing System, http://www.theokspindoctor.com/hollow.html (Apr. 29, 2011).

Donald Derry Hollowing Systems, http://derrytools.com/lightning.htm (Apr. 29, 2011).

Elbo Tool, http://www.elbotool.com (Apr. 29, 2011).

Infinity Hollowing System, http://www.fulmerwoodworking.com/tools_extra.html (Apr. 29, 2011).

Johnston/Basham, http://kestrelcreek.com/Articles/Hollowing_Tools.htm (Apr. 29, 2011).

Kelton System, http://www.kelton.co.nz/browsers/hollowing_rig_stand_home.html (Apr. 29, 2011).

Kobra Hollowing System, http://www.svwoodturners.org/Handouts/HollowingSystems/KobraPricing.html (Apr. 29, 2011).

Lyle Jamieson, https://www.lylejamieson.com/tools/index.asp (04/29/20110.

Monster Captive System, http://monster-lathe-tools.com/cart.php?target=category&category_id=63 (Apr. 29, 2011).

Reeks System, http://www.gambier.d.reeks.btinternet.co.uk/tools.htm (Apr. 29, 2011).

Vermec Ultimate Deep Hollow System, http://vermec.tripod.com/PDFs/ultimatedeephollowset.pdf (undated).

Vicmarc, http://www.vicmarc.com/default.asp?contentID=546 (Apr. 29, 2011).

Mini O, http://www.svwoodturners.org/Handouts/HollowingSystems1.html (Apr. 29, 2011).

* cited by examiner

HOLLOW FORM TURNING DEVICE

CLAIM OF PRIORITY

Applicants hereby claim the priority benefits under the provisions of 35 U.S.C. §120, basing said claim of priority on related provisional U.S. patent application Ser. No. 61/487,972, filed May 19, 2011, and said provisional application is incorporated herein by reference in its entirety.

BACKGROUND

The present invention relates to a hollow turning device and method for use in forming hollowed items on a turning lathe.

SUMMARY OF THE INVENTION

Turning lathes, particularly for wooden work pieces, have long been used for creating hollowed forms, such as bowls and vases. Generally, a wooden work piece is secured to a motorized lathe and a handheld cutting tool is used to cut away wood from inside the work piece to form the inner walls of the hollowed form. Usually, a tool rest is placed adjacent the work piece and the handheld tool is advanced into the work piece to create the hollowed form.

It is an objective of this disclosure to provide a hollow turning device that allows precise control of the cutting tool forward and backwards, as well as side to side, that is, in certain axes, while preventing movement along other axes and rotational movement. Thus, the tool can be advanced or retracted to shape the inside of the hollowed form without the stress of force and torque generated by the turning wood piece, resulting in easier, faster and safer removal of the solid wood to form the hollowed item.

According to the practice of this system, this hollow turning device comprises a tool handle, a cutting bar extending from one end of the tool handle, where the cutting bar has a longitudinal axis and a cross section at least a portion of which is non-circular, and a cutting tool disposed at a distal end of the cutting bar. A tool rest is disposed adjacent the work piece. A torque arrestor is provided having a pair of spaced apart cooperating rollers between which the cutting bar extends, the cooperating rollers being spaced apart to fittingly receive and restrain the cutting bar to allow motion of the cutting bar between the cooperating rollers to facilitate lateral motion and forward and rearward motion of the cutting tool within the hollow to shape the inside of the work piece, wherein the non-circular portion of the cutting bar cross section prevents vertical movement and rotation of the cutting bar along its longitudinal axis when the cutting tool engages the work piece. In the preferred embodiment, the cutting bar has a cross section that is circular about more than half its circumference and flat along the remainder of its circumference.

An advantage of this system is in the fact that the cutting bar may be moved relative the work piece with little or no rotation of the cutting bar through the use of an efficient and economic restraining device. With less stress on the operator, more precise and controlled cutting operations may be obtained.

These and other objects and advantages of this system will be more readily apparent from the following description of the drawings in which:

BRIEF DESCRIPTION OF THE DRAWING FIGURES

DETAILED DESCRIPTION OF THE PREFERRED EMBODIMENTS

Figure 1:
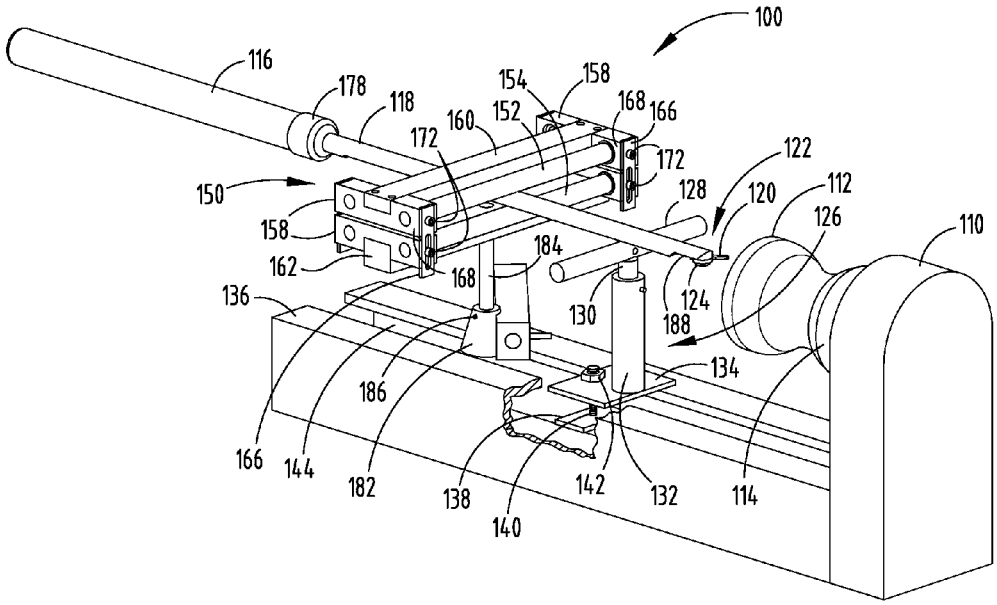
FIG. 1 is a perspective view of a hollow turning device of the present disclosure in situ.

For purposes of description herein, the terms "upper," "lower," "right," "left," "rear," "front," "vertical," "horizontal," and derivatives thereof shall relate to the system as oriented in FIG. 1. However, it is to be understood that the system may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
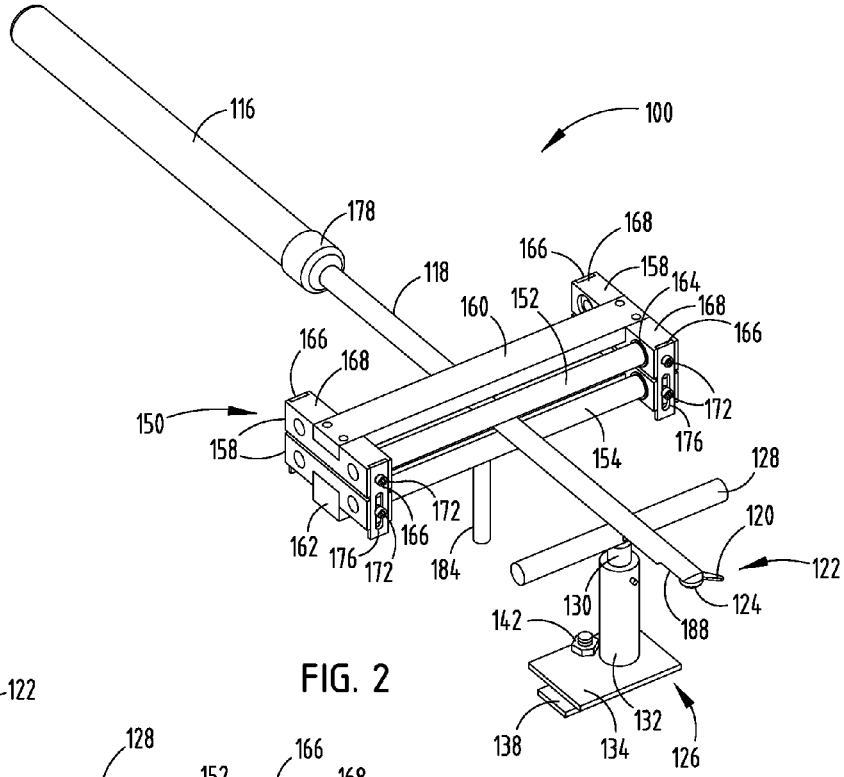
FIG. 2 is an enlarged perspective view of the hollow turning device of the present disclosure shown in FIG. 1.
Figure 3:
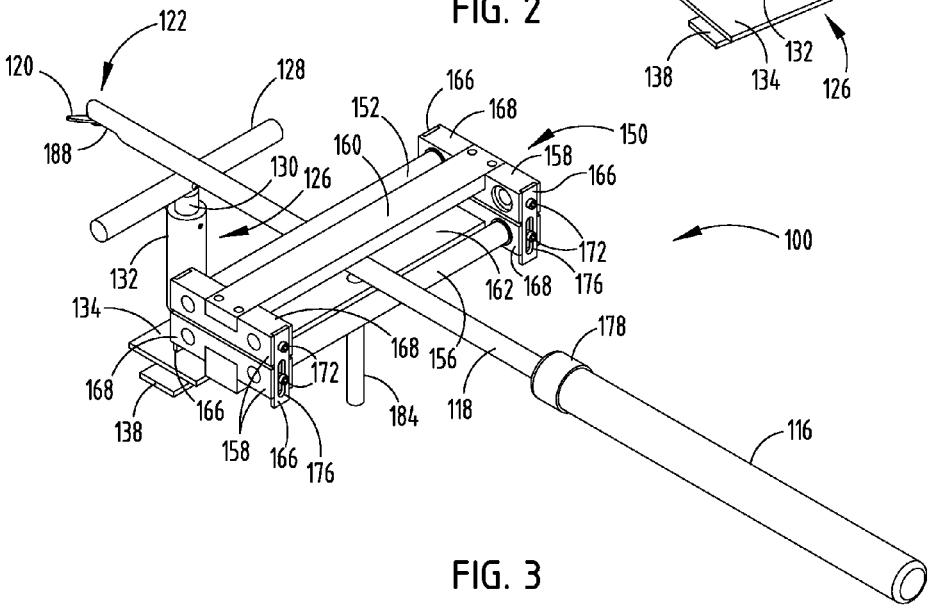
FIG. 3 is another perspective view of the hollow turning device of the present disclosure.
Figure 4:
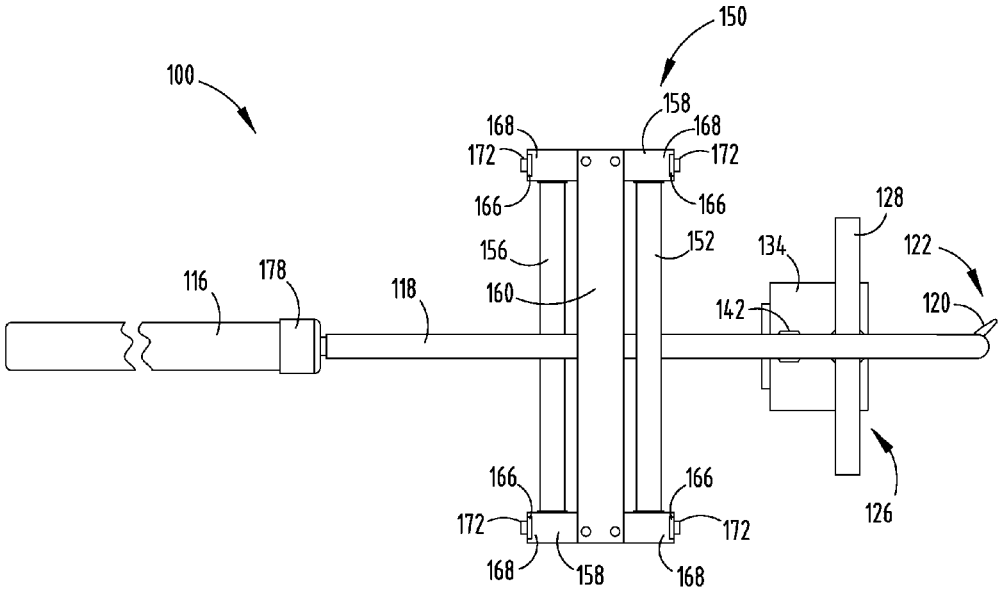
FIG. 4 is a top view of the hollow turning device of the present disclosure.
Figure 5:
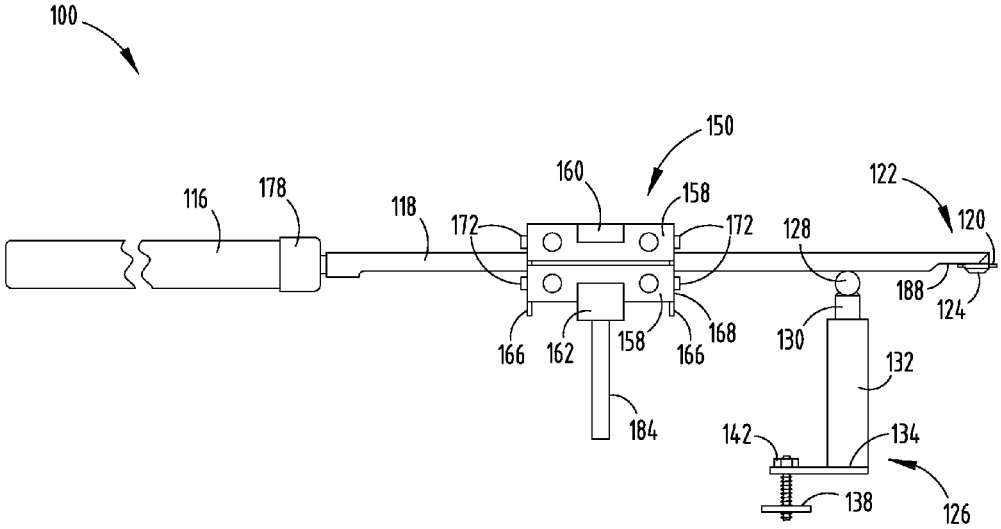
FIG. 5 is a side view of the hollow turning device of the present disclosure.
Figure 6:
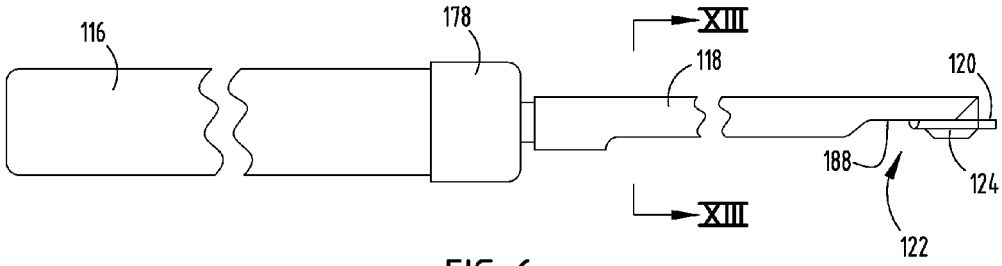
FIG. 6 is a side view of the handle, cutting bar, and cutting tool of the hollow turning device of the present disclosure.
Figure 7:
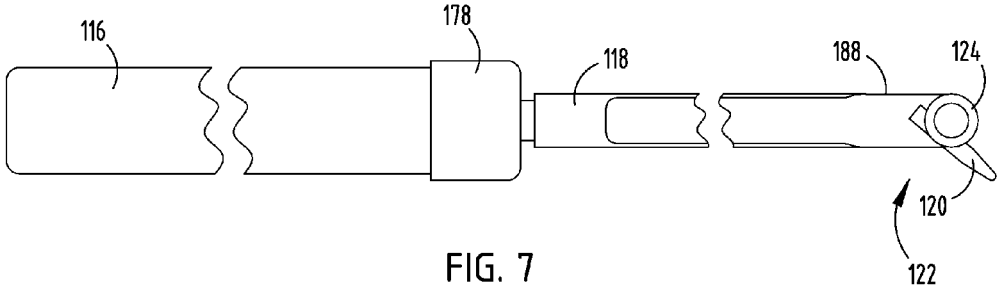
FIG. 7 is a bottom view of the handle, cutting bar, and cutting tool of the hollow turning device of the present disclosure.
Figure 13:
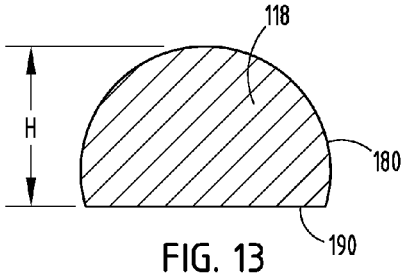
FIG. 13 is a cross-sectional view of the cutting bar of the hollow turning device of the present disclosure taken along the line XIII-XIII in FIG. 6.

Referring to FIGS. 1 and 2, it will be seen that the hollow turning device 100 of this system is mounted either on or adjacent to a lathe 110. A work piece 112, such as a piece of wood that has had its exterior surface turned to the desired profile, is mounted to and supported for operational rotation by motor 114 on the lathe 110. An assembly is provided that includes a tool handle 116, a cutting bar 118 extending from one end of the tool handle 116, and a cutting tool 120 disposed at a distal end 122 of the cutting bar 118. The cutting tool 120 is secured to a tool holder 124 placed at the distal end 122 of the cutting bar 118. The cutting tool 120 can be any type of cutter for removing wood or other materials from the work piece 112, such as a gouge, parting tool, skew chisel, round nose chisel, spear point chisel, or scraper.

A tool rest 126 is mounted to the lathe 110 adjacent the work piece 112. The tool rest 126 supports the cutting bar 118 for removing wood or other material from the work piece 112. The tool rest 126 includes a tool rest horizontal bar 128 arranged perpendicularly to a tool rest adjustment post 130, which is received within a mating tool rest support 132. The tool rest support 132 includes a tool rest base 134 that sits atop the lathe bed 136. A tool rest tension plate 138 is attached to the underside of the tool rest base 134 by a fastener 140 that is operationally engaged and threadably received in a hex nut 142 for mounting the tool rest base 134 to the latch bed 136. The tool rest 126 is secured in place by tightening the fastener 140 in the tool rest base 134, making sure the tool rest tension plate 138 spans across the way 144 of the lathe bed 136 and contacts both undersides of ways 144. It is contemplated that the hex nut 142 may be replaced with a toggle handle provided with a cam that, upon rotation to a locked position, secures the tool rest 126. The height of the tool rest 126 is adjusted by loosening a set screw 148 in the tool rest 126 and moving the tool rest horizontal bar 128 up to touch the bottom of the cutting bar 118.

A torque arrestor 150 is preferably mounted to the lathe 110. The torque arrestor 150 is provided with a pair of spaced apart cooperating rollers 152, 154, between which the cutting bar 118 extends, and a trailing roller 156. A pair of cooperating end brackets 158 is located on each side of the torque arrestor 150 and are joined to a top support bar 160 and a bottom support bar 162 positioned on both sides of the torque arrestor 150. Each of the rollers 152, 154, 156 is held within the torque arrestor 150 by a bearing 164 to facilitate rotation of the rollers. A locking plate 166 is provided on each of the forward and rearward faces 168 of the pair of end brackets 158. An upper portion 170 of the locking plates 166 has an opening for receiving a set screw 172, while a lower portion 174 of the locking plates 166 has a slot 176 for receiving a set screw 172 to adjust the spacing between the cooperating rollers 152, 154. The cooperating rollers 152, 154 are thus spaced apart to fittingly receive and restrain the cutting bar 118 to allow motion of the cutting bar 118 between the cooperating rollers 152, 154, as further discussed below. This relationship facilitates lateral and longitudinal motion of the cutting tool 120, allowing the operator to move the cutting tool 120 side-to-side and to advance and retract the cutting tool 120 within the hollow to shape the inside of the work piece 112.

The handle 116 is assembled to the cutting bar 118 by a collar 178 receiving the cutting bar 118. The collar 178, having an opening, is slid onto the cutting bar 118 until the collet (not shown) at the end of cutting bar 118 stops against the collar 178, as is known. The collet and cutting bar 118 are inserted into the handle 116, and the collar 178 is screwed onto the handle 116 and hand-tightened to ensure the cutting bar 118 cannot be removed after tightening. The handle 116, when assembled, is preferably hollow and adapted to receive sand, grit, or some other relatively dense and heavy material for providing greater stability.

Figure 14:
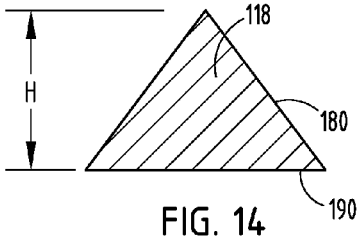
FIG. 14 is a cross-sectional view of another embodiment of the cutting bar of the hollow turning device of the present disclosure.
Figure 8:
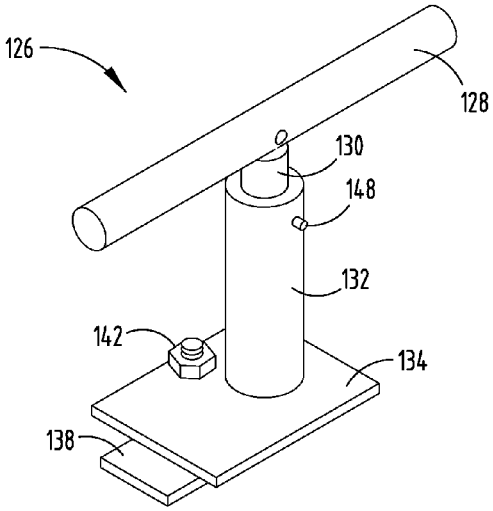
FIG. 8 is a perspective view of the tool rest of the hollow turning device of the present disclosure.
Figure 9:
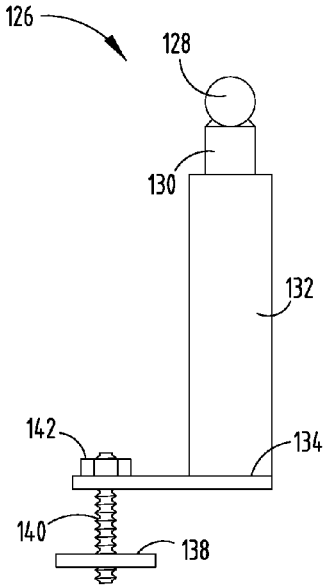
FIG. 9 is a side view of the tool rest of the hollow turning device of the present disclosure.
Figure 10:
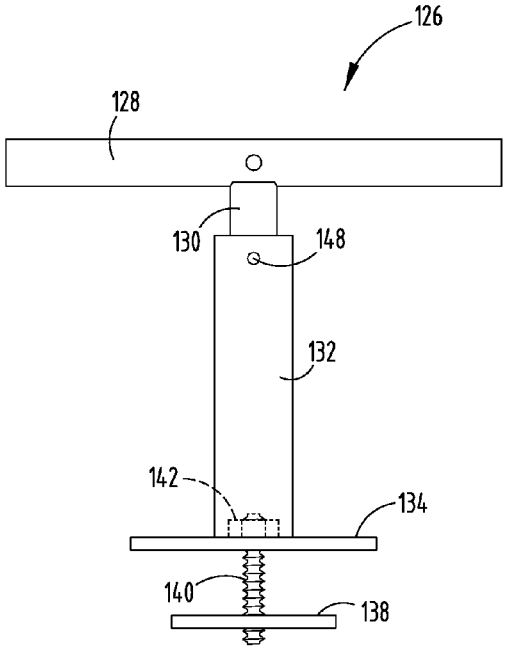
FIG. 10 is a front view of the tool rest of the hollow turning device of the present disclosure.
Figure 11:
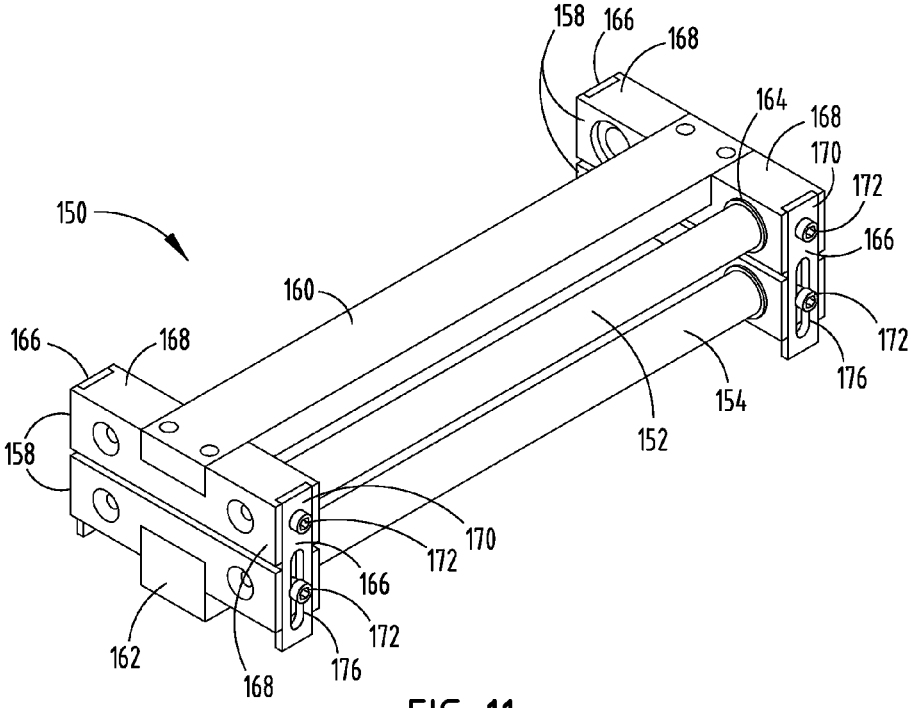
FIG. 11 is a perspective view of the torque arrestor of the hollow turning device of the present disclosure.
Figure 12:
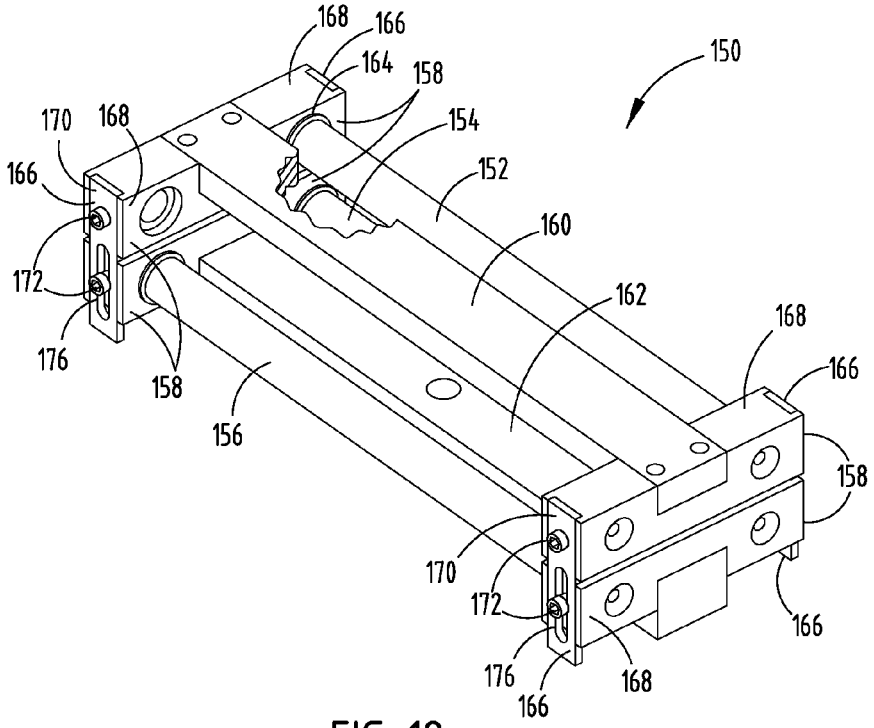
FIG. 12 is another perspective view of the torque arrestor of the hollow turning device of the present disclosure.

The cutting bar 118 has a longitudinal axis and a cross section 180 at least a portion 190 of which is non-circular. Preferably, the cutting bar 118 has a cross section 180 along a substantial portion of its longitudinal axis that is circular about more than half its circumference and a flat portion 190 about the remainder of its circumference, as best shown in FIGS. 6, 7, 13, and 14. The non-circular portion 190 of the cutting bar cross section 180, when positioned between the cooperating rollers 152, 154, defines a profile height H which is less than the overall diameter of the cutting bar 118 and prevents vertical movement and rotation of the cutting bar 118 along its longitudinal axis when the cutting tool engages the work piece. In the preferred embodiment, the non-circular portion 190 of the cross section 180 of the cutting bar 118 is a flat secant positioned adjacent to and parallel with one of the pair of spaced apart cooperating rollers 152, 154 between which the cutting bar 118 extends. The opposite side of the cutting bar 118 is positioned adjacent to the other of the pair of spaced apart cooperating rollers 152, 154 between which the cutting bar 118 extends. It should further be noted that the cross section 180 of the cutting bar 118 need not have a circular portion at all, and can, for example, assume a triangular cross-sectional shape as shown in FIG. 14 and still enjoy the advantages of the present disclosure.

The torque arrestor 150 is mounted to the lathe 110 via banjo 182 through an adaptor stud 184 installed into the bottom support bar 162 of the torque arrestor 150 and preferably secured with two set screws on the flats of the adaptor stud 184 (not shown). The torque arrestor 150 thus supports the cutting bar 118 such that the cutting bar 118 extends generally parallel to a longitudinal axis of the lathe 110. Although the torque arrestor 150 has been described as using the banjo 182 for mounting to the lathe 110, it should be understood that the torque arrestor 150 can be mounted to the lathe 110 via any suitable manner, such as a weld, a clamp, bolts, screws, or the like. The torque arrestor 150 can also be mounted to a stand, ceiling, or other device positioned adjacent to the lathe 110.

In operation, after the exterior of the work piece 112 is turned to the desired form or shape on the lathe, the hollow turning device 100 is installed by first removing the banjo 182 from lathe 110. Next, the tension plate 138 of tool rest 126 is loosened, slid onto lathe bed 130 from the opposite end of work piece 112, and the tool rest 126 is secured approximately 3" from the front surface of the work piece 112. The banjo 182 is then re-installed with its mounting hole farthest away from operator position and is temporarily positioned approximately 10" behind tool rest 126. This position will be adjusted later before turning.

The adaptor stud 184 is then installed into bottom support bar 162 of the torque arrestor 150 and preferably secured with two set screws on the flats of the adaptor stud. The adaptor stud 184 is then installed on the banjo 182 with the pair of cooperating rollers 152, 154 closest to the work piece and temporarily secured to check alignment of the torque arrestor rollers 152, 154.

The handle 116 is then assembled to the cutting bar 118 by unscrewing the collar 178 with the hole and removing the collet installed in the handle. The collar 178 is slid onto the cutting bar until the collet at the end of cutting bar stops against the collar 178. The collet and cutting bar 118 are inserted into the handle 116, and the collar 178 is screwed onto the handle and hand-tightened to make sure the cutting bar 118 cannot be removed after tightening.

The cutting bar 118 is then slid into the torque arrestor 150 with the flat portion of the cross section 180 of the cutting bar 118 facing down. The rollers 152, 154 on the torque arrestor 150 are preferably adjustable for proper fit and alignment before turning. That is, the entire torque arrestor 150 is adjusted vertically by adjusting the height of the adaptor stud 184 relative the banjo 182 so that the cutting tool 120 is positioned slightly above the center of turning piece 112. The adaptor stud 184 is then locked securely in place. The banjo 182 is then positioned by moving the cutting tool 120 close to the face of the work piece 112 and securing the banjo 182 with the torque arrestor 150 at about the midpoint of the cutting bar 118. This position can be adjusted with the banjo 182 during turning for deeper cuts or wider cuts by simply moving the banjo 182 in any direction.

The tool rest 126 height is adjusted by loosening the bottom set screw 148 in the tool rest 126 and moving the tool rest horizontal bar 128 up to touch the bottom of the cutting bar 118. The tool rest 126 is then placed so that the cutting tool 120 is close to the face of the work piece 112, and slightly behind the cutting tool recess 188 created by the flat portion 190 of the cutting bar 118 on the bottom side of the cutting bar 118. The tool rest 126 is then secured in place by tightening the fastener 140 and hex nut 142 in the base of the tool rest 126, making sure the tension plate 138 spans across the way 144 of the lathe bed and contacts both undersides of ways 144.

The torque arrestor 150 may be adjusted according to the wood species or turning styles of the lathe 110. After inserting the cutting bar 118 between the rollers 152, 154 of the torque arrestor 150, the cutting bar 118 should roll smoothly on the rollers 152, 154, 156 but have no more than a paper thickness between the cutting bar 118 and the double rollers 152, 154 at any spot along the width of the rollers 152, 154. If there is more than a paper thickness between the cutting bar 118 and the double rollers 152, 154, torque arrestor 150 should be adjusted by placing the cutting bar 118 on one side of the torque arrestor 150. The lower set screws 148 are loosened and the pair of rollers 152, 154 squeezed together with a piece of folded paper inserted between the cutting bar 118 and the top roller 154. The lower set screws 148 are then tightened. This operation is repeated for the opposite side of the torque arrestor 150. When the cutting bar 118 is slid back and forth between the torque arrestor rollers 152, 154, the cutting bar 118 should move smoothly in all available directions.

The lathe 110 is then actuated to spin the work piece 112. The work piece 112 is then shaped in a well-known manner by advancing the tool 120 into and/or out of the work piece 112. The torque arrestor 150 resists the forces created between the work piece 112 and the tool 120 so that the user does not have to restrain these significant forces. Thus, the primary advantage of this system resides in the ease with which the cutting bar 118 may be moved relative the work piece 112 with little or no rotation and little or no vertical movement of the cutting bar 118 through the use of an efficient and economic restraining device 100. With less stress on the operator, more precise and controlled cutting operations may be obtained.

The above description is considered that of the preferred embodiments only. Modifications of the system will occur to those skilled in the art and to those who make or use the system. Therefore, it is understood that the embodiments shown in the drawings and described above are merely for illustrative purposes and not intended to limit the scope of the invention, which is solely defined by the following claims as interpreted according to the principles of patent law, including the doctrine of equivalents.

We claim:

1. A device for forming a hollow within a rotating work piece on a lathe, the device comprising:

a tool handle, a cutting bar extending from one end of the tool handle, the cutting bar having a longitudinal axis and a cross section at least a portion of which is non-circular, and a cutting tool disposed at a distal end of the cutting bar;

a tool rest mounted to the lathe and disposed adjacent the work piece; supporting the cutting bar; and a torque arrestor having a pair of spaced apart cooperating rollers between which the cutting bar extends, the cooperating rollers being spaced apart to fittingly receive and restrain the non-circular portion of the cutting bar to allow motion of the cutting bar between the cooperating rollers to facilitate lateral motion of the cutting tool and advancing and retracting the cutting tool within the work piece to shape the inside of the work piece, wherein the non-circular portion of the cutting bar cross section prevents vertical movement and rotation of the cutting bar along its longitudinal axis when the cutting tool engages the work piece.

2. The forming device of claim 1, wherein the lathe has a lathe bed and a banjo, the tool rest being mounted to the lathe bed and the torque arrestor being mounted to the banjo of the lathe through an adaptor stud.

3. The forming device of claim 1, wherein each end of the pair of spaced apart cooperating rollers are contained by a pair of cooperating end brackets joined together by a top support bar and a bottom support bar, each pair of cooperating end brackets being positioned on opposing sides of the torque arrestor.

4. The forming device of claim 3, wherein each of the spaced apart cooperating rollers is held within the torque arrestor by a bearing to facilitate rotation of the rollers and further comprising a pair of locking plates provided on each of a forward and rearward face of the pair of end brackets, an upper portion of the locking plates having an opening for receiving a set screw and a lower portion of the locking plates having a slot for receiving a set screw to adjust the spacing between the spaced apart cooperating rollers.

5. The forming device of claim 3 further comprising a third roller for supporting the cutting bar.

6. The forming device of claim 1, wherein the support rollers are arranged horizontally.

7. The forming device of claim 1, wherein the cutting bar has a cross section that is circular about more than half its circumference and non-circular along the remainder of its circumference.

8. The forming device of claim 1, wherein the cutting bar has a cross section that is triangular.

9. The forming device of claim 1, wherein the non-circular portion of the cutting bar is a flat secant.

10. The forming device of claim 1, wherein the non-circular portion of the cutting bar cross section is a secant positioned adjacent to and parallel with one of the pair of spaced apart cooperating rollers between which the cutting bar extends and the opposite side of the cutting bar is positioned adjacent to the other of the pair of spaced apart cooperating rollers between which the cutting bar extends.

11. A device for forming an item comprising:

a cutting bar having a handle end, a cutting end opposite the handle end, a longitudinal axis, a cross section at least a portion of which is non-circular to define a profile height of the cutting bar, and a cutting tool disposed at a distal end of the cutting bar proximate the item; and a torque arrestor having a pair of cooperating rollers spaced apart substantially the same distance as the profile height between which the cutting bar extends, the cooperating rollers being spaced apart to fittingly receive and restrain the non-circular portion of the cutting bar to allow motion of the cutting bar between the cooperating rollers to facilitate lateral motion of the cutting tool and advancing and retracting the cutting tool within the item to shape the inside of the item, wherein the non-circular portion of the cutting bar cross section prevents vertical movement and rotation of the cutting bar along its longitudinal axis when the cutting tool engages the item.

12. The forming device of claim 11, wherein the non-circular portion of the cutting bar cross section is a secant positioned adjacent to and parallel with one of the pair of spaced apart cooperating rollers between which the cutting bar extend and the opposite side of the cutting bar is positioned adjacent to the other of the pair of spaced apart cooperating rollers between which the cutting bar extends.

13. The forming device of claim 11 wherein the device for forming an item further comprises a lathe and a tool rest mounted to the lathe adjacent the work piece, wherein the lathe has a lathe bed and a banjo, the tool rest being mounted to the lathe bed and the torque arrestor being mounted to the banjo of the lathe through an adaptor stud.

14. The forming device of claim 11, wherein each end of the pair of spaced apart cooperating rollers are contained by a pair of cooperating end brackets joined together by a top support bar and a bottom support bar, each pair of cooperating end brackets being positioned on opposing sides of the torque arrestor.

15. The forming device of claim 14, wherein each of the spaced apart cooperating rollers is held within the torque arrestor by a bearing to facilitate rotation of the rollers and further comprising a pair of locking plates provided on each of a forward and rearward face of the pair of end brackets, an upper portion of the locking plates having an opening for receiving a set screw and a lower portion of the locking plates having a slot for receiving a set screw to adjust the spacing between the spaced apart cooperating rollers.

16. The forming device of claim 11, wherein the cutting bar has a cross section that is circular about more than half its circumference and non-circular along the remainder of its circumference.

17. The forming device of claim 11, wherein the cutting bar has a cross section that is triangular.

18. A device for forming a hollow within a rotating work piece on a lathe, the device comprising:

a tool handle, a cutting bar extending from one end of the tool handle, the cutting bar having a longitudinal axis and a cross section at least a portion of which is non-circular, and a cutting tool disposed at a distal end of the cutting bar;

a tool rest mounted to the lathe and disposed adjacent the work piece; and a torque arrestor comprising a pair of spaced apart cooperating rollers between which the cutting bar extends, the cooperating rollers being spaced apart to fittingly receive and restrain the cutting bar to allow motion of the cutting bar between the cooperating rollers to facilitate lateral motion of the cutting tool and advancing and retracting the cutting tool within the work piece to shape the inside of the work piece, a pair of cooperating end brackets joined together by a top support bar and a bottom support bar containing the ends of the pair of spaced apart cooperating rollers, each pair of cooperating end brackets being positioned on opposing sides of the torque arrestor, a bearing holding each end of the spaced apart cooperating rollers within the torque arrestor to facilitate rotation of the rollers, and a pair of locking plates provided on each of a forward and rearward face of the pair of end brackets, an upper portion of the locking plates having an opening for receiving a set screw and a lower portion of the locking plates having a slot for receiving a set screw to adjust the spacing between the spaced apart cooperating rollers;

wherein the non-circular portion of the cutting bar cross section prevents vertical movement and a rotation of the cutting bar along its longitudinal axis when the cutting tool engages the work piece.

19. A device for forming an item comprising:

a cutting bar having a handle end, a cutting end opposite the handle end, a longitudinal axis, a cross section at least a portion of which is non-circular to define a profile height of the cutting bar, and a cutting tool disposed at a distal end of the cutting bar proximate the item; and a torque arrestor comprising a pair of cooperating rollers and a pair of cooperating end brackets joined together by a top support bar and a bottom support bar containing each end of the pair of spaced apart cooperating rollers, each pair of cooperating end brackets being positioned on opposing sides of the torque arrestor and each of the spaced apart cooperating rollers being held within the torque arrestor by a bearing to facilitate rotation of the rollers, and a pair of locking plates provided on each of a forward and rearward face of the pair of end brackets, an upper portion of the locking plates having an opening for receiving a set screw and a lower portion of the locking plates having a slot for receiving a set screw to adjust the spacing between the spaced apart cooperating rollers;

wherein the cooperating rollers are spaced apart substantially the same distance as a profile height between which the cutting bar extends, and the cooperating rollers are spaced apart to fittingly receive and restrain the cutting bar to allow motion of the cutting bar between the cooperating rollers to facilitate lateral motion of the cutting tool and advancing and retracting the cutting tool within the item to shape the inside of the item, wherein the non-circular portion of the cutting bar cross section prevents vertical movement and rotation of the cutting bar along its longitudinal axis when the cutting tool engages the item.

* * * * *